US011518949B2

(12) United States Patent
Xu et al.

(10) Patent No.: US 11,518,949 B2
(45) Date of Patent: Dec. 6, 2022

(54) PROCESS FOR PRODUCING PROPYLENE AND A LOW-SULFUR FUEL OIL COMPONENT

(71) Applicants: CHINA PETROLEUM & CHEMICAL CORPORATION, Beijing (CN); RESEARCH INSTITUTE OF PETROLEUM PROCESSING, SINOPEC, Beijing (CN)

(72) Inventors: Youhao Xu, Beijing (CN); Xuhui Bai, Beijing (CN); Xinyu Xie, Beijing (CN); Shouye Cui, Beijing (CN); Xin Wang, Beijing (CN); Yanfen Zuo, Beijing (CN)

(73) Assignees: CHINA PETROLEUM & CHEMICAL CORPORATION, Beijing (CN); RESEARCH INSTITUTE OF PETROLEUM PROCESSING, SINOPEC, Beijing (CN)

( * ) Notice: Subject to any disclaimer, the term of this patent is extended or adjusted under 35 U.S.C. 154(b) by 0 days.

(21) Appl. No.: 16/949,319

(22) Filed: Oct. 26, 2020

(65) Prior Publication Data

US 2021/0122983 A1 Apr. 29, 2021

(30) Foreign Application Priority Data

Oct. 24, 2019 (CN) ..... 201911014995.6

(51) Int. Cl.

| | |
|---|---|
| ***C10G 69/04*** | (2006.01) |
| ***C10G 55/06*** | (2006.01)***C10G 11/05*** |
| (2006.01) | ***C10G 21/14*** |
| (2006.01) | ***C10G 21/00*** |
| (2006.01) | |

(Continued)

(52) U.S. Cl.

CPC ..... *C10G 69/04* (2013.01); *C10G 11/05* (2013.01); *C10G 11/18* (2013.01); *C10G 21/003* (2013.01);

(Continued)

(58) Field of Classification Search

CPC ..... C10G 55/06; C10G 69/04

See application file for complete search history.

(56) References Cited

U.S. PATENT DOCUMENTS 3,891,540 A * 6/1975 Demmel ..... C10G 11/18 208/77

3,951,781 A 4/1976 Owen et al.

(Continued)

FOREIGN PATENT DOCUMENTS

CN 1004878 A 7/1989

CN 1078094 C 1/2002

(Continued)

OTHER PUBLICATIONS

Englsih machine translation of CN 101987972, obtained from Google Patents. (Year: 2011).*

*Primary Examiner* — Renee Robinson

(74) *Attorney, Agent, or Firm* — Novick, Kim & Lee, PLLC; Allen Xue

(57) ABSTRACT

A process for producing propylene and a low-sulfur fuel oil component, comprising the steps of contacting a heavy feedstock oil with a solvent for extraction separation to obtain a deasphalted oil and a deoiled asphalt; contacting the deasphalted oil and optionally a light feedstock oil with a catalytic conversion catalyst for reaction to obtain a reaction product comprising propylene; separating the reaction product to obtain a catalytic cracking distillate oil, and subjecting the catalytic cracking distillate oil to hydrodesulfurization to obtain a low-sulfur hydrogenated distillate oil, wherein the low-sulfur hydrogenated distillate oil and/or the deoiled (Continued)

asphalt is suitable for use as a fuel oil component. The process allows the conversion of saturated hydrocarbons in the heavy feedstock into propylene, eliminates the use of saturated hydrocarbons in the fuel oil component, and thus has better economic and social benefits.

18 Claims, 4 Drawing Sheets

(51) Int. Cl.
*C10G 11/18* (2006.01)
*C10G 45/10* (2006.01)

(52) U.S. Cl.
CPC ..... *C10G 21/14* (2013.01); *C10G 45/10* (2013.01); *C10G 55/06* (2013.01); *C10G 2300/206* (2013.01); *C10G 2300/301* (2013.01); *C10G 2300/4006* (2013.01); *C10G 2300/4012* (2013.01); *C10G 2300/4018* (2013.01); *C10G 2400/20* (2013.01)

(56) References Cited

U.S. PATENT DOCUMENTS 4,054,512 A * 10/1977 Dugan ..... C10G 21/003 208/309
4,940,529 A * 7/1990 Beaton ..... C10G 69/04 208/108
5,098,554 A * 3/1992 Krishna ..... C10G 11/18 208/113
5,192,421 A * 3/1993 Audeh ..... C10G 21/003 208/309
2007/0095724 A1* 5/2007 Baptista ..... C10G 11/18 208/113
2011/0000818 A1* 1/2011 Xu ..... C10G 11/18 208/70
2011/0062054 A1* 3/2011 Gao ..... C10G 11/18 208/57
2016/0312130 A1* 10/2016 Merdrignac ..... C10G 21/06

FOREIGN PATENT DOCUMENTS

CN 101283074 A 10/2008
CN 101987972 A 3/2011
CN 102373084 A 3/2012
CN 102399585 A 4/2012
CN 102746890 A 10/2012
CN 103059954 A 4/2013
CN 105623725 A 6/2016
CN 109705913 A 5/2019
EP 0940464 A2 9/1999
WO 2017116756 A1 7/2017

* cited by examiner

PROCESS FOR PRODUCING PROPYLENE AND A LOW-SULFUR FUEL OIL COMPONENT

CROSS REFERENCE TO RELATED APPLICATIONS

The present application claims the priority of a Chinese patent application No. 201911014995.6 filed on Oct. 24, 2019, titled "process for producing more propylene and low-sulfur fuel oil component", which is incorporated herein by reference in its entirety.

TECHNICAL FIELD

The application relates to the field of catalytic conversion of hydrocarbon oils, particularly to a catalytic conversion process for converting heavy feedstock oil into light olefins and low-sulfur fuel oil components.

BACKGROUND ART

With the rapid development of social economy, the environmental protection concept of treatment after pollution has been replaced by the environmental protection concept of pollution prevention from the source. The problem of environmental pollution has received more and more attention, and corresponding laws and regulations are increasingly strict. According to the regulation, International Convention for the Prevention of Pollution from Ships, of International Maritime Organization (IMO), from Jan. 1, 2020, ships all over the world must use marine fuels with a sulfur content of no greater than 0.5%. According to BP prediction, global consumption of marine fuels in 2020 can reach about 3 hundred million tons, which will bring a huge challenge to the global fuel market and major petroleum processing enterprises.

Meanwhile, the problem that crude oils are becoming heavier and more inferior has been encountered all over the world. The reserve of heavy crude oil is estimated to account for about 50% of the recoverable reserve of crude oil around the world after the year of 2020. The price difference between inferior crude oil and high-quality crude oil is increasing, and the problem of how to efficiently utilize and process inferior heavy oil to produce high-value products, improve the yield and produce low-sulfur marine fuel satisfying higher environmental protection requirements has become an urgent problem faced by refineries and suppliers, and a challenge has also been brought to traditional crude oil processing technology.

CN102746890A discloses a process for producing marine fuels, in which a feedstock oil is subjected to visbreaking and fractionation to obtain a visbreaking blending component. The process can reduce the production cost of the marine fuel. The process comprises the steps of: 1) visbreaking a heavy oil component; 2) fractionating the visbreaking product and collecting a fraction having a high distillation range; and 3) mixing the fraction having a high distillation range with a light oil component to obtain a marine fuel.

As the price of marine fuels is lower than that of vehicle diesel oils, production of marine fuels is difficult to provide better economic benefit. Thus, producing marine fuels while producing high-value products such as propylene by a process for producing light olefins in high yields, directing at the component characteristics of feedstock oil, has important significance.

Accordingly, in view of the deterioration of oil quality and the strict requirement of environmental protection around the world, it is necessary to develop a process for producing high-value propylene in high yield while producing low-sulfur marine fuel components, which can satisfy the market demand for high-quality fuel oils and improve the economic benefits of enterprises.

SUMMARY OF THE INVENTION

An object of the present application is to provide a process for producing propylene and a low-sulfur fuel oil component from heavy oils, which allows the conversion of saturated hydrocarbons in the heavy feedstock oil into propylene, and the conversion of polycyclic aromatics containing an aromatic core structure into a fuel oil component, eliminates the use of saturated hydrocarbons in the fuel oil component, and thus has better economic and social benefits.

To achieve the above object, the present application provides a process for producing propylene and a low-sulfur fuel oil component, comprising the steps of:

(1) contacting a heavy feedstock oil with a solvent for extraction separation to obtain a deasphalted oil and a deoiled asphalt;

(2) contacting the deasphalted oil and optionally a light feedstock oil with a catalytic conversion catalyst for reaction in a catalytic conversion reactor in the absence of hydrogen to obtain a reaction product comprising propylene;

(3) separating the reaction product from step (2) to obtain a catalytic cracking distillate oil, wherein the catalytic cracking distillate oil has an initial boiling point of no less than about 200° C., a final boiling point of no greater than about 550° C., and a hydrogen content of no greater than about 12.0 wt %; and (4) subjecting the catalytic cracking distillate oil to hydrodesulfurization to obtain a low-sulfur hydrogenated distillate oil, wherein the low-sulfur hydrogenated distillate oil and/or the deoiled asphalt is suitable for use as a fuel oil component, wherein the catalytic conversion catalyst used in step (2) comprises about 1-50 wt % zeolite, about 5-99 wt % inorganic oxide, and about 0-70 wt % clay, based on the total weight of the catalyst, the reaction conditions of the step (2) include: a reaction temperature of about 460-750° C., and preferably about 480-700° C.; a weight hourly space velocity of about 10-100 $^{-1}$, preferably about 30-100 $h^{-1}$, or a reaction time of about 1-10 seconds, preferably about 2-8 seconds; and a catalyst-to-oil weight ratio of about 4-20, preferably about 5-12.

In the process of the present application, asphaltenes and resins are separated from the heavy feedstock oil through solvent deasphalting, then the deoiled asphalt can be used as a fuel oil component, and the deasphalted oil is used as a feedstock for selective catalytic cracking, so that propylene and a catalytic cracking distillate oil containing short-side-chain polycyclic aromatics can be obtained to a maximum extent. The catalytic cracking distillate oil can be used as a fuel oil component alone or in a mixture with the deoiled asphalt or heavy deasphalted oil. By using the process of the present application, a heavy feedstock oil can be converted into propylene, butylene and a fuel oil component, with a great reduction of the yields of dry gas and coke, so that effective utilization of petroleum resources can be realized.

In particular, when compared to prior arts, the process of the present application can provide at least one of the following benefits:

1. A high-value product, propylene, can be produced in a high yield from a heavy feedstock oil, together with a fuel oil component. By using the process, about 5-20 wt % of propylene and about 30-80 wt % of a fuel oil component relative to the weight of feedstock oil (heavy feedstock oil+light feedstock oil) can be produced, and thus more economic benefits can be obtained as compared to a simple use of the feedstock oil for the blending of fuel oils;

2. The production of high-value products such as propylene and the like can be significantly increased, with a great reduction of the yields of dry gas and coke;

3. The total liquid yield can be greatly increased, with substantially no slurry oil being discharged, so that the efficiency of utilization of petroleum resources can be improved;

4. The catalytic conversion unit is integrated with the solvent deasphalting unit, and the properties of the catalytic cracking distillate oil obtained from the catalytic conversion unit can be modified by adjusting the solvent used in the solvent deasphalting unit and the amount of the light feedstock oil used, so that the process is adaptable for different amounts of heavy feedstock oil and fuel oil component.

BRIEF DESCRIPTION OF THE DRAWINGS

The drawings, forming a part of the present description, are provided to help the understanding of the present application, and should not be considered to be limiting. The present application can be interpreted with reference to the drawings in combination with the detailed description hereinbelow. In the drawings.

DETAILED DESCRIPTION OF THE INVENTION

Figure 1:
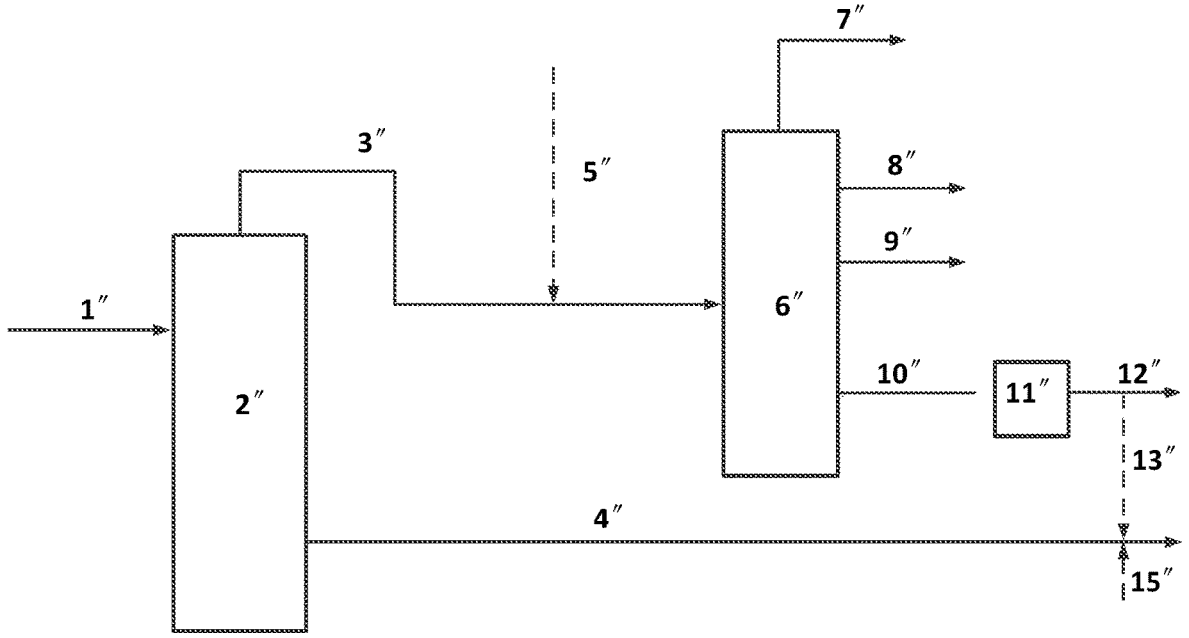
FIG. 1 shows a schematic flow diagram of a preferred embodiment of the process according to the present application.

The present application will be further described hereinafter in detail with reference to specific embodiments thereof and the accompanying drawings. It should be noted that the specific embodiments of the present application are provided for illustration purpose only, and are not intended to be limiting in any manner.

Any specific numerical value, including the endpoints of a numerical range, described in the context of the present application is not restricted to the exact value thereof, but should be interpreted to further encompass all values close to said exact value, for example all values within ±5% of said exact value. Moreover, regarding any numerical range described herein, arbitrary combinations can be made between the endpoints of the range, between each endpoint and any specific value within the range, or between any two specific values within the range, to provide one or more new numerical range(s), where said new numerical range(s) should also be deemed to have been specifically described in the present application.

Unless otherwise stated, the terms used herein have the same meaning as commonly understood by those skilled in the art; and if the terms are defined herein and their definitions are different from the ordinary understanding in the art, the definition provided herein shall prevail.

According to the present application, the term "catalytic cracking distillate oil" refers to a fraction having an initial boiling point of no less than about 200° C., preferably no less than about 250° C., and a final boiling point of no more than about 550° C., preferably no more than about 520° C., and most preferably no more than about 500° C. in the product of the catalytic convention reaction, i.e. a fraction having a distillation range of about 200-550° C., preferably about 250-520° C., more preferably about 250-500° C.

In the present application, the term "fluidized bed reactor", also referred to as "fluidized reactor", should be understood in its broadest sense, and covers all types of reactors that allow a gaseous feedstock to contact with solid catalyst particles in a fluidized state therein for a chemical reaction, including but not limited to dense bed, bubbling bed, boiling bed, turbulent bed, fast bed, gas phase transport bed (such as upflow fluidized bed and downflow fluidized bed, and the like. The fluidized bed reactor may be constant linear speed fluidized bed reactors, equal-diameter fluidized bed reactors, varied-diameter fluidized bed reactors, or the like, and may also be a composite reactor comprising two or more different types of fluidized beds connected in series or in parallel, such as a riser reactor or a composite reactor comprising a riser reactor in combination with a dense bed. Typically, the gas velocity of a dense bed may be in a range of about 0.1-2 m/s, while the gas velocity of a riser reactor may be in a range of about 1-30 m/s (excluding the catalyst).

In the context of the present application, in addition to those matters explicitly stated, any matter or matters not mentioned are considered to be the same as those known in the art without any change. Moreover, any of the embodiments described herein can be freely combined with another one or more embodiments described herein, and the technical solutions or ideas thus obtained are considered as part of the original disclosure or original description of the present application, and should not be considered to be a new matter that has not been disclosed or anticipated herein, unless it is clear to those skilled in the art that such a combination is obviously unreasonable.

All of the patent and non-patent documents cited herein, including but not limited to textbooks and journal articles, are hereby incorporated by reference in their entireties.

As described above, the present application provides a process for producing propylene and a fuel oil component, comprising the steps of:

(1) contacting a heavy feedstock oil with a solvent for extraction separation to obtain a deasphalted oil and a deoiled asphalt;

(2) contacting the deasphalted oil and optionally a light feedstock oil with a catalytic conversion catalyst for reaction in a catalytic conversion reactor in the absence of hydrogen to obtain a reaction product comprising propylene;

(3) separating the product from step (2) to obtain a catalytic cracking distillate oil, and optionally a liquefied gas comprising propylene and a gasoline; and (4) subjecting the catalytic cracking distillate oil to hydrodesulfurization to obtain a low-sulfur hydrogenated distillate oil;

wherein the low-sulfur hydrogenated distillate oil and/or deoiled asphalt may be used as a fuel oil component.

According to the present application, the step (1) is a solvent deasphalting step, which can be carried out in a single stage or in two stages. In certain preferred embodiments, the step (1) is carried out in two stages to obtain a light deasphalted oil, a heavy deasphalted oil and a deoiled asphalt, wherein the light deasphalted oil is used as the feedstock oil for the catalytic conversion step (2), the heavy deasphalted oil can be used as a fuel oil component or for other purposes, and the deoiled asphalt can be used as a fuel oil component or as a road asphalt product depending on its sulfur content.

According to the present application, the heavy feedstock oil used in step (1) can be any heavy oil suitable for use in the catalytic conversion process, and may be selected from, for example, vacuum residues, inferior atmospheric residues, hydrogenated heavy oils, or any mixtures thereof.

According to the present application, the solvent used in step (1) can be any solvent suitable for use in the solvent deasphalting process of heavy oils, and may be selected from, for example, lower alkanes such as propane, butane, pentane, and the like, or any mixtures thereof, and the deasphalting solvent can be selected according to the properties of the catalytic cracking distillate oil obtained from the catalytic conversion unit.

In a preferred embodiment, the conditions of the solvent deasphalting step (1) may include: a temperature of about 10-200° C., preferably about 20-180° C.; a pressure of about 1.0-15.0 MPa, preferably about 2.0-10.0 MPa; a mass ratio of the solvent to the heavy feedstock oil (also referred to as "solvent ratio") of about 1-20, preferably about 3-10.

According to the present application, the light feedstock oil used in step (2) may be selected from the group consisting of petroleum hydrocarbons, other mineral oils, or mixtures thereof, in which the petroleum hydrocarbon may be selected from the group consisting of vacuum gas oils, atmospheric gas oils, coker gas oils, high-quality residues, high-quality hydrogenated heavy oils, or any mixtures thereof, said other mineral oil may be selected from the group consisting of coal liquefied oils, tar sand oils, shale oils, or any mixtures thereof, wherein said "high-quality residues" and "high-quality hydrogenated heavy oils" respectively refer to residues and hydrogenated heavy oils having a hydrogen content of 11.2% or more, preferably 12.0% or more, and most preferably 12.5% or more.

According to the present application, the catalytic conversion reactor used in step (2) may be selected from various types of fluidized bed reactors, such as a single fluidized bed reactor, or a composite reactor comprising a plurality of fluidized bed reactors connected in series or in parallel. In certain preferred embodiments, the fluidized bed reactor may be an equal-diameter riser reactor or various types of varied-diameter fluidized bed reactors, such as the reactor disclosed in Chinese Patent No. CN 1078094C.

According to the present application, the catalytic conversion catalyst used in step (2) may comprise about 1-50 wt % zeolite, about 5-99 wt % inorganic oxide, and about 0-70 wt % clay, based on the total weight of the catalyst. Preferably, the catalyst may comprise about 5-45 wt % zeolite, more preferably about 10-40 wt % zeolite, about 5-80 wt % inorganic oxide and about 10-70 wt % clay.

In a preferred embodiment, the zeolite may comprise about 51-100 wt %, preferably about 70-100 wt %, of a mesoporous zeolite and about 0-49 wt %, preferably about 0-30 wt %, of a macroporous zeolite, based on the total weight of the zeolite, preferably the mesoporous zeolite has a silica-alumina ratio of greater than about 10, preferably greater than about 50, more preferably greater than about 100. The mesoporous zeolite is preferably selected from the group consisting of ZSM-type zeolites and ZRP zeolites; the macroporous zeolite is preferably a Y-type zeolite. Optionally, the zeolite may be modified with a non-metallic element, such as phosphorus and the like, and/or a transition metal element, such as iron, cobalt, nickel and the like. The inorganic oxide is preferably selected from the group consisting of silica, alumina, and combinations thereof; and the clay is preferably selected from kaolin and/or halloysite.

According to the present application, the step (2) is carried out under effective conditions, wherein said "effective conditions" refer to conditions that allow the reaction feedstock to undergo a catalytic conversion reaction to obtain a reaction product comprising propylene and a catalytic cracking distillate oil, preferably comprising about 8-25 wt % propylene and about 15-50 wt % catalytic cracking distillate oil, relative to the weight of the reaction feedstock (i.e. the deasphalted oil plus the optional light feedstock oil). In a preferred embodiment, the reaction conditions of step (2) include: a reaction temperature of about 460-750° C., preferably about 480-700° C., more preferably about 480-600° C., and most preferably about 500-560° C.; a weight hourly space velocity (e.g., for a dense bed reactor, a fast bed reactor, etc.) of about 5-100 $h^{-1}$, preferably about 10-70 $h^{-1}$, more preferably about 15-50 $h^{-1}$, most preferably about 18-40 $h^{-1}$ or a reaction time (e.g., for a riser reactor) of about 1-10 seconds, preferably about 2-8 seconds, more preferably about 2.5-8 seconds, most preferably about 3-8 seconds; a weight ratio of the catalytic conversion catalyst to the catalytic conversion feedstock oil (also referred to as "catalyst-to-oil weight ratio" or "catalyst-to-oil ratio") of about 4-20, preferably about 5-12, preferably about 5-10, and more preferably about 5-9.

In a preferred embodiment, the step (2) is carried out to such an extent that the resulting reaction product has a propylene/propane mass ratio of no less than about 4, preferably no less than about 6, and most preferably no less than about 8; and/or an isobutene/isobutane mass ratio of no less than about 1, preferably no less than about 1.5, most preferably no less than about 1.8.

In a preferred embodiment, the step (2) is carried out to such an extent that the yield of the catalytic cracking distillate oil in the resulting reaction product, i.e., a weight ratio of the catalytic cracking distillate oil to the feedstock oil for the catalytic conversion reaction (i.e., the deasphalted oil and the optional light feedstock oil), is not less than about 15%, preferably not less than about 20%, more preferably not less than about 30%, and not more than about 50%.

As is well known to those skilled in the art, the conversion rate of feedstock oil in a catalytic conversion process is typically expressed as the sum of the yields of gas, gasoline and coke. In the process of the present application, the end products of the catalytic conversion process include only dry gas, liquefied gas, gasoline, catalytic cracking distillate oil and coke. Thus, in the present application, the conversion rate of the feedstock oil is substantially equal to 100% minus the yield of the catalytic cracking distillate oil. In turn, the conversion rate of the catalytic conversion process according to the present application is controlled to a level of no greater than about 85%, preferably no greater than about 80%, and most preferably no greater than about 70%, and no less than about 50%.

In a particularly preferred embodiment, the process further comprises a step of separating the reaction product of step (2) from the spent catalyst, wherein the spent catalyst is recycled to the reactor after stripping and regeneration by coke burning, and wherein the separated reaction product comprises propylene, gasoline and the catalytic cracking distillate oil. Methods for separating materials such as propylene from the reaction product are well known to those skilled in the art, and methods for solvent deasphalting of heavy feedstock oils are also well known to those skilled in the art and will not be described in detail herein.

According to the present application, the catalytic cracking distillate oil obtained in step (3) has an initial boiling point of no less than about 200° C., a final boiling point of no more than about 550° C., and a hydrogen content of no more than about 12.0 wt %. Preferably, the catalytic cracking distillate oil has an initial boiling point of no less than about 250° C., a final boiling point of no greater than about 520° C., more preferably no greater than 500° C., and a hydrogen content of no greater than about 11.0 wt %.

According to the present application, the fuel oil component may be formed by optionally mixing the hydrodesulfurized catalytic cracking distillate oil with the deoiled asphalt or heavy deasphalted oil obtained in the solvent deasphalting unit.

According to the present application, the catalyst used in the hydrodesulfurization step (4) is preferably a catalyst comprising a Group VIB metal and/or a Group VIII metal supported on an alumina and/or amorphous silica-alumina carrier. More preferably, the catalyst used in the hydrotreating step (4) comprises about 0-10 wt % of an additive, about 1-40 wt % of at least one Group VIII metal (calculated as metal oxide), and about 1-50 wt % of at least one Group VIB metal (calculated as metal oxide), with the balance being a carrier selected from alumina and amorphous silica-alumina, wherein the additive comprises a non-metallic element selected from fluorine, phosphorus, and the like, a metallic element selected from titanium, platinum, and the like, or a combination thereof. For example, the additive may be a phosphorus-containing auxiliary or a fluorine-containing auxiliary, such as ammonium fluoride. The Group VIB metal is preferably selected from molybdenum, tungsten or a combination thereof; and the Group VIII metal is preferably selected from nickel, cobalt or a combination thereof.

In a preferred embodiment, the conditions of the hydrodesulfurization step (4) include: a reaction pressure of about 2.0-24.0 MPa, preferably about 3.0-15 MPa; a reaction temperature of about 200-500° C., preferably about 300-400° C.; a hydrogen-to-oil volume ratio of about 50-5000 $N^3/m^3$, preferably about 200-2000 $N^3/m^3$; a liquid hourly space velocity of about 0.1-30.0 $h^{-1}$, preferably about 0.2-10.0 $h^{-1}$.

In a preferred embodiment, the low-sulfur hydrogenated distillate oil obtained in step (4) via the hydrodesulfurization of the catalytic cracking distillate oil has a sulfur content of no greater than about 0.1%, preferably no greater than about 0.05%.

In a particularly preferred embodiment, the process according to the present application comprises the steps of:

(1) contacting a heavy feedstock oil with a solvent in a single-stage solvent deasphalting unit for extraction separation to obtain a deasphalted oil and a deoiled asphalt;

(2) contacting the deasphalted oil and optionally a light feedstock oil with a catalytic conversion catalyst for reaction in a catalytic conversion reactor in the absence of hydrogen to obtain a reaction product comprising propylene;

(3) separating the reaction product from step (2) to obtain dry gas, a liquefied gas comprising propylene, gasoline and a catalytic cracking distillate oil, wherein the liquefied gas can be further separated to obtain propylene, propane and C4 hydrocarbons; and (4) subjecting the catalytic cracking distillate oil to hydrodesulfurization to obtain a low-sulfur hydrogenated distillate oil;

wherein the low-sulfur hydrogenated distillate oil can be used alone as a fuel oil component or blended with the deoiled asphalt as a fuel oil component;

preferably, the low-sulfur hydrogenated distillate oil is blended with the deoiled asphalt to form a fuel oil component or product.

In another particularly preferred embodiment, the process according to the present application comprises the steps of:

(1) contacting a heavy feedstock oil with a solvent in a two-stage solvent deasphalting unit for extraction separation to obtain a light deasphalted oil, a heavy deasphalted oil and a deoiled asphalt;

(2) contacting the light deasphalted oil and optionally a light feedstock oil with a catalytic conversion catalyst for reaction in a catalytic conversion reactor in the absence of hydrogen to obtain a reaction product comprising propylene;

(3) separating the reaction product from step (2) to obtain dry gas, a liquefied gas comprising propylene, gasoline and a catalytic cracking distillate oil, wherein the liquefied gas can be further separated to obtain propylene, propane and C4 hydrocarbons; and (4) subjecting the catalytic cracking distillate oil to hydrodesulfurization to obtain a low-sulfur hydrogenated distillate oil;

wherein the low-sulfur hydrogenated distillate oil can be used alone as a fuel oil component or blended with the heavy deasphalted oil or the deoiled asphalt as a fuel oil component;

preferably, the low-sulfur hydrogenated distillate oil is blended with the heavy deasphalted oil as a fuel oil component or product.

A preferred embodiment of the process according to the present application is described below with reference to the drawings.

In a particularly preferred embodiment, as shown in FIG. 1, a heavy feedstock oil is fed via a pipeline 1" into a single-stage solvent deasphalting unit 2" and contacted with a solvent (not shown) for separation, to obtain a deasphalted oil and a deoiled asphalt. The deoiled asphalt is discharged via a pipeline 4", and the solvent is recycled (not shown). The deasphalted oil is sent to a catalytic conversion unit 6" through a pipeline 3", optionally after being mixed with a light feedstock oil from a pipeline 5", to contact with a catalytic conversion catalyst for reaction. After a separation of the catalytic conversion product, the dry gas obtained is discharged through a pipeline 7"; the liquefied gas obtained is withdrawn through a pipeline 8" and can be further separated into propylene, propane and C4 hydrocarbons; the gasoline obtained is discharged through a pipeline 9"; the catalytic cracking distillate oil obtained is withdrawn via pipeline 10", and subjected to a hydrodesulfurization treatment in a hydrodesulfurization unit 11". The hydrogenated catalytic cracking distillate oil is withdrawn as a fuel oil component via a pipeline 12", or blended with the deoiled asphalt from pipeline 4" through a pipeline 13", or optionally further blended with a light distillate oil from a pipeline 15", as a fuel oil component or product.

Figure 2:
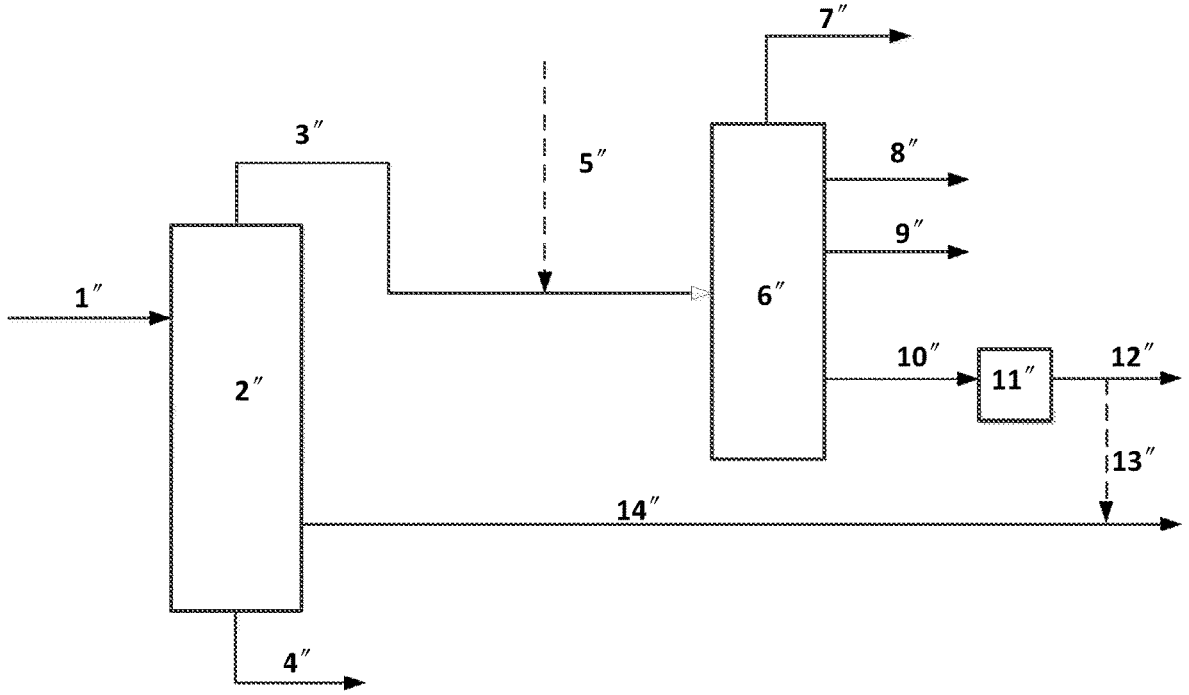
FIG. 2 shows a schematic flow diagram of another preferred embodiment of the process according to the present application.
Figure 3:
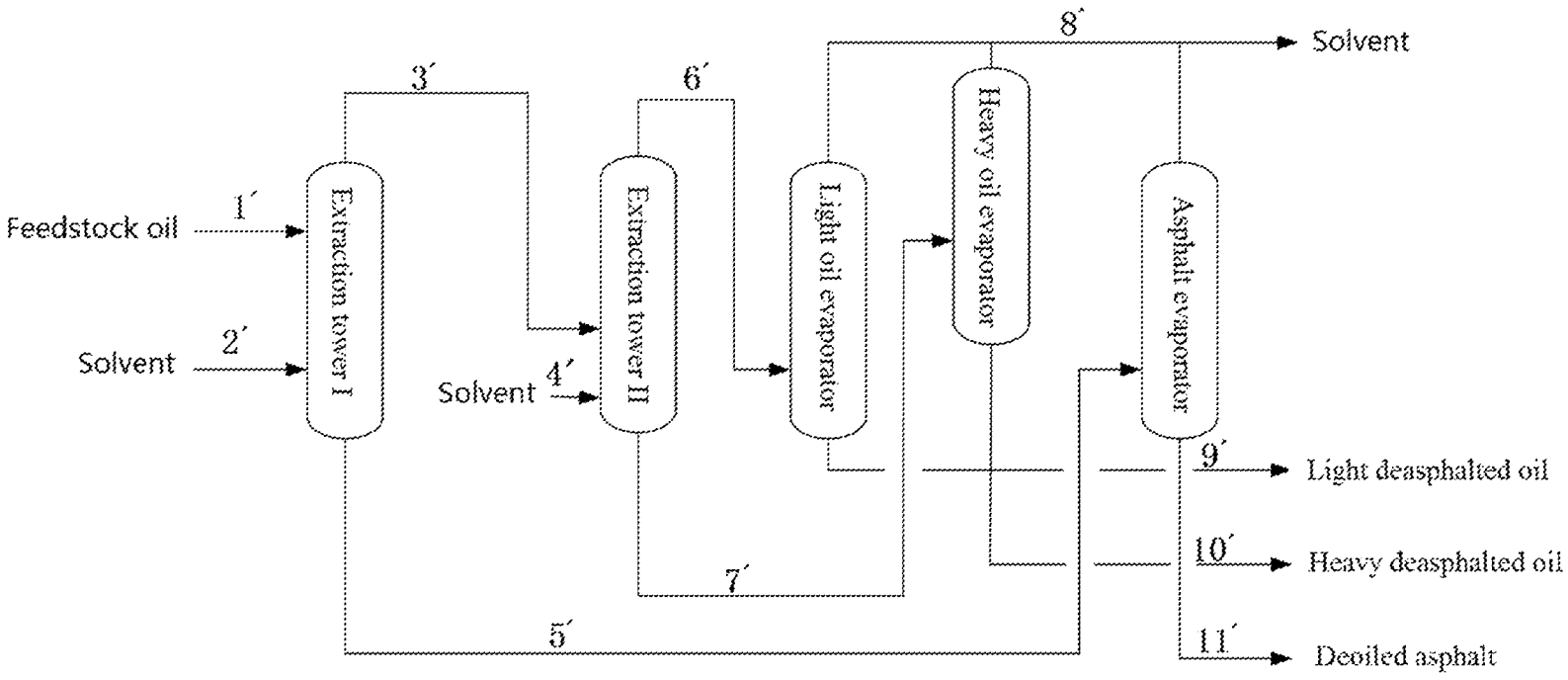
FIG. 3 shows a schematic diagram of a preferred embodiment of the solvent deasphalting unit used in the present application.

In another particularly preferred embodiment, as shown in FIG. 2, a heavy feedstock oil is fed via a pipeline 1" into a two-stage solvent deasphalting unit 2" (the process scheme of the two-stage solvent deasphalting is schematically shown in FIG. 3) and contacted with a solvent (not shown) for separation, to obtain a light deasphalted oil, a heavy deasphalted oil and a deoiled asphalt. The heavy deasphalted oil and the deoiled asphalt are respectively discharged via pipelines 14" and 4", and the solvent is recycled (not shown). The light deasphalted oil is sent to a catalytic conversion unit 6" through a pipeline 3", optionally after being mixed with a light feedstock oil from a pipeline 5", to contact with a catalytic conversion catalyst for reaction. After a separation of the catalytic conversion product, the dry gas obtained is discharged through a pipeline 7"; the liquefied gas obtained is withdrawn through a pipeline 8" and can be further separated into propylene, propane and C4 hydrocarbons; the gasoline obtained is discharged through a pipeline 9"; and the catalytic cracking distillate oil obtained in withdrawn via a pipeline 10" and subjected to a hydrodesulfurization treatment in a hydrodesulfurization unit 11". The hydrogenated catalytic cracking distillate oil is withdrawn as a fuel oil component via a pipeline 12", or blended with the heavy deasphalted oil from pipeline 14" via a pipeline 13" as a fuel oil component or product.

FIG. 3 shows a two-stage solvent deasphalting process, in which a feedstock oil is fed into an extraction tower I of a deasphalting unit through a pipeline 1' and is contacted with a solvent from a pipeline 2' for separation to obtain a deasphalted oil and a deoiled asphalt containing the solvent. The deoiled asphalt containing the solvent is sent to an asphalt evaporator through a pipeline 5' for separation, the deoiled asphalt obtained is discharged through a pipeline 11', and the solvent is discharged through a pipeline 8'. The deasphalted oil is sent to an extraction tower II through a pipeline 3' to contact with a solvent from a pipeline 4' for separation to obtain a light deasphalted oil and a heavy deasphalted oil. The light deasphalted oil is sent to a light oil evaporator through a pipeline 6' for separation, the solvent is discharged through pipeline 8', and the light deasphalted oil is discharged through a pipeline 9'; the heavy deasphalted oil is sent to a heavy oil evaporator through a pipeline 7' for separation, the solvent is discharged through pipeline 8', and the heavy deasphalted oil is discharged through a pipeline 10'.

Figure 4:
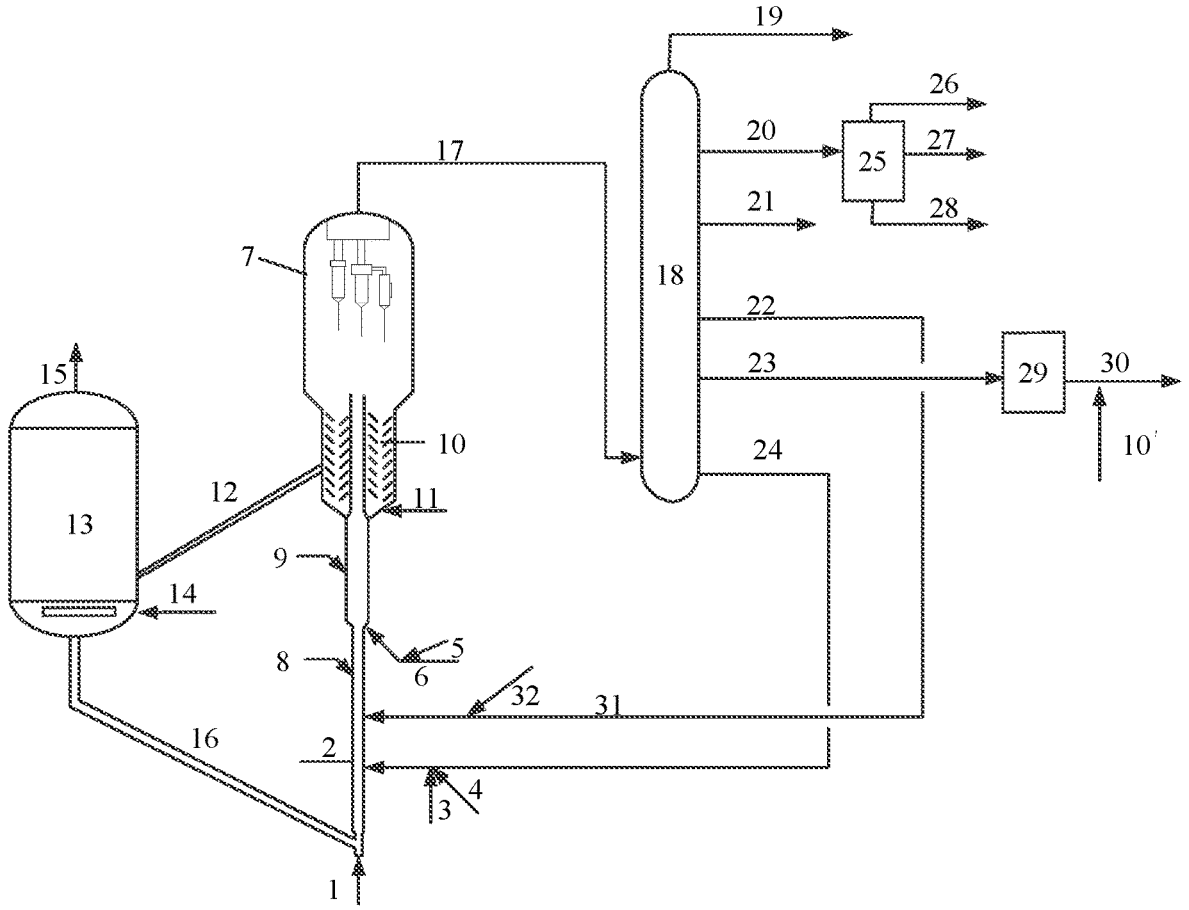
FIG. 4 shows a schematic diagram of a preferred embodiment of the catalytic conversion unit used in the present application.

As shown in FIG. 4, in a particularly preferred embodiment, a pre-lifting medium is introduced into the bottom of a varied-diameter fluidized bed reactor 2 (such as the reactor disclosed in Chinese Patent No. CN 1078094C) through a pipeline 1, a regenerated catalyst from a regenerated catalyst sloped pipe 16 moves upwards along the reactor under the action of the pre-lifting medium, and a light deasphalted oil from a pipeline 9' is fed into the bottom of a first reaction zone 8 of the varied-diameter fluidized bed reactor 2 through a pipeline 3 together with an atomized steam from a pipeline 4 to be mixed with the existing stream in the reactor. The feedstock oil is cracked on the hot catalyst and moves upwards into a second reaction zone 9 of the varied-diameter fluidized bed reactor 2 for further reaction. The resulting oil gas and inactivated spent catalyst are passed to a cyclone separator in a disengager 7 to accomplish the separation of the spent catalyst and the oil gas. The oil gas is passed to a main oil gas pipeline 17, and fine powders of the catalyst are returned to the disengager 7 through a dipleg of the cyclone separator. The spent catalyst in the disengager 7 is passed to a stripping section 10 and is contacted with a stripping steam from a pipeline 11. The oil gas stripped from the spent catalyst is passed through the cyclone separator into the main oil gas pipeline 17. The stripped spent catalyst is sent to a regenerator 13 through a spent catalyst sloped pipe 12, and a main air is introduced into the regenerator through a pipeline 14 to burn out the coke deposited on the spent catalyst, so that the inactivated spent catalyst can be regenerated. A flue gas is discharged through a pipeline 15. The regenerated catalyst is recycled to the varied-diameter fluidized bed reactor 2 through the regenerated catalyst sloped pipe 16 for reuse.

The oil gas is passed to a subsequent fractionation unit 18 through the main oil gas pipeline 17, and after separation, the dry gas obtained is discharged through a pipeline 19; the liquefied gas obtained is discharged through a pipeline 20, and is separated into propylene, propane and C4 hydrocarbons in a gas separation unit 25, and the propylene, propane and C4 hydrocarbons are discharged through pipelines 26, 27 and 28 respectively; the gasoline obtained is discharged through a pipeline 21; the light cycle oil fraction obtained having a distillation range of 200-250° C. is withdrawn through a pipeline 22 and then recycled to the middle-upper part of the first reaction zone 8 of the varied-diameter fluidized bed reactor 2 through a pipeline 31 together with an atomized steam from a pipeline 32; the slurry oil obtained is withdrawn through a pipeline 24 and recycled to the first reaction zone 8 of the varied-diameter fluidized bed reactor 2 (optionally passed into the first reaction zone 8 together with the feedstock oil from the pipeline 3 through a feedstock nozzle) for refining so as to recover fine powders of the catalyst; the catalytic cracking distillate oil obtained is passed to a hydrotreating unit 29 through a pipeline 23, and the hydrogenated distillate oil obtained after the hydrotreatment is withdrawn through a pipeline 30, along with the heavy deasphalted oil from the pipeline 10', as a blending component for marine fuels. The distillation range and the processing scheme of each fraction can be adjusted according to the actual needs of a refinery, for example, the gasoline may be split to obtain a light gasoline fraction, and the light gasoline fraction may be recycled to the second reaction zone 9 of the varied-diameter fluidized bed reactor 2 through a pipeline 6 together with an atomized steam from a pipeline 5 for refining to increase the yield of propylene.

In certain preferred embodiments, the present application provides the following technical solutions:

1. A process for producing more propylene and a low-sulfur fuel oil component, comprising the steps of:

(1) contacting a heavy feedstock oil with a solvent for extraction separation to obtain a deasphalted oil and a deoiled asphalt;

(2) feeding the deasphalted oil and optionally a light feedstock oil as a catalytic conversion feedstock oil into a catalytic conversion reactor to contact with a catalytic conversion catalyst for reaction, to obtain a liquefied gas comprising propylene, gasoline and a catalytic cracking distillate oil;

(3) subjecting the catalytic cracking distillate oil to hydrodesulfurization to obtain a low-sulfur hydrogenated distillate oil;

wherein the low-sulfur hydrogenated distillate oil and/or the deoiled asphalt are used as a fuel oil component.

2. The process according to Item 1, wherein the heavy feedstock oil is selected from the group consisting of vacuum residues, inferior atmospheric residues, hydrogenated heavy oils, or a mixture of two or more thereof.

3. The process according to Item 1, wherein the solvent is selected from lower alkanes, or a mixture of two or more thereof, and wherein the lower alkane is selected from the group consisting of propane, butane and pentane, or a mixture of two or more thereof.

4. The process according to Item 1, wherein the step (1) is carried out at an operating temperature of 10-200° C., preferably 20-180° C., an operating pressure of 1.0-15.0 MPa, preferably 2.0-10.0 MPa, and a mass ratio of the solvent to the feedstock oil of 1-20, preferably 3-10.

5. The process according to Item 1, wherein the light feedstock oil used in step (2) is selected from petroleum hydrocarbons and/or other mineral oils, wherein the petroleum hydrocarbon is selected from the group consisting of vacuum gas oils, atmospheric gas oils, coker gas oils, high-quality residues, high-quality hydrogenated heavy oils, or a mixture of two or more thereof, and said other mineral oil is selected from the group consisting of coal liquefied oils, tar sand oils, shale oils, or a mixture of two or more thereof.

6. The process according to Item 1, wherein in step (2) the reactor is selected from the group consisting of a riser reactor, a constant linear speed fluidized bed, an equal-diameter fluidized bed, an upflow conveyor line, a downflow conveyor line, a combination of two or more thereof, or a combination of two or more reactors of the same type, including a combination of reactors connected in series and/or in parallel, wherein the riser reactor is a conventional equal-diameter riser reactor or various types of varied-diameter fluidized beds.

7. The process according to Item 1, wherein the catalytic conversion catalyst used in step (2) comprises 1-50 wt % of zeolite, 5-99 wt % of inorganic oxide and 0-70 wt % of clay, based on the total weight of the catalyst, in which the zeolite is mesoporous zeolite and optionally macroporous zeolite, in which the mesoporous zeolite accounts for 51-100 wt % of the total weight of the zeolite, the mesoporous zeolite has a silica-alumina ratio of greater than 50, preferably greater than 80, and the macroporous zeolite accounts for 0-49 wt % of the total weight of the zeolite.

8. The process according to Item 1, wherein the conditions for the catalytic conversion in step (2) include: a reaction temperature of 460-750° C., preferably 480-700° C., a weight hourly space velocity of 10-100 $h^{-1}$, preferably 30-80 $h^{-1}$, and a weight ratio of the catalyst to the catalytic conversion feedstock oil of 4-20, preferably 5-12.

9. The process according to Item 1, wherein the catalytic cracking distillate oil obtained in step (2) has an initial boiling point of no less than 200° C. and a hydrogen content of no more than 12.0 wt %.

10. The process according to Item 9, wherein the catalytic cracking distillate oil has an initial boiling point of no less than 250° C. and a hydrogen content of no more than 11.0 wt %.

11. The process according to Item 1, wherein the catalyst used in the hydrodesulfurization step (3) is a catalyst comprising a Group VIB metal and/or a Group VIII metal supported on an alumina and/or amorphous silica-alumina carrier.

12. The process according to Item 11, wherein the hydrotreating catalyst is comprised of 0-10 wt % of an additive, 1-40 wt % of one or more Group VIII metals, 1-50 wt % of one or more Group VIB metals, and a balance amount of alumina and/or amorphous silica-alumina carrier, wherein the additive is selected from the group consisting of non-metallic elements such as fluorine, phosphorus, and the like, and metallic elements such as titanium, platinum, and the like.

13. The process according to Item 1, wherein the hydrodesulfurization conditions include: a reaction pressure of 2.0-24.0 MPa, a reaction temperature of 200-500° C., a hydrogen-to-oil volume ratio of 50-5000 $Nm^3/m^3$, and a liquid hourly space velocity of 0.1-30.0 $h^{-1}$.

14. The process according to Item 13, wherein the hydrodesulfurization conditions include: a reaction pressure of 3.0-15.0 MPa, a reaction temperature of 300-400° C., a hydrogen-to-oil volume ratio is 200-2000 $Nm^3/m^3$, and a liquid hourly space velocity of 0.2-10.0 $h^{-1}$.

15. The process according to Item 1, wherein the hydrogenated distillate oil obtained in step (3) has a sulfur content of no more than 0.1%, preferably no more than 0.05%.

EXAMPLES

The present application will be further described with reference to the following examples, but is not limited thereto.

Properties of the feedstock oil and the catalyst used in the following examples and comparative examples are shown in Tables 1 and 2, respectively. The catalytic conversion catalyst used in the comparative examples was MMC-1, a catalyst manufactured by Qilu Branch of Sinopec Catalyst Co., Ltd.

The hydrogen content of the catalytic cracking distillate oil obtained in each example is measured by a carbon and hydrogen analysis meter according to the NB/SH/T 0656-2017 standard.

The catalytic conversion catalyst used in the examples was prepared as follows:

969 g of halloysite (available from China Kaolin clay Co., Ltd., with solid content of 73%) was slurried in 4300 g of decationized water, 781 g of pseudo-boehmite (available from Shandong Zibo Bauxite Plant, with solid content of 64%) and 144 ml of hydrochloric acid (with concentration of 30% and specific gravity of 1.56) were added and stirred evenly. The mixture was kept still and aged for 1 hour at 60° C., the pH value was kept at 2-4, and then the mixture was cooled to room temperature. 5000 g of a pre-prepared slurry comprising 1600 g of a mesoporous shape-selective ZSM-5 zeolite (available from Qilu Branch of Sinopec Catalyst Co., Ltd.) containing chemical water and having a silica-alumina ratio higher than 150 was added and stirred evenly, and the resultant was spray dried and washed off free $Na^+$ to obtain a catalyst. The catalyst obtained was aged at 800° C. with 100% steam, and the aged catalyst was designated as catalyst A, of which the properties are shown in Table 2.

The hydrodesulfurization catalyst B used in the examples was prepared as follows:

1000 g of pseudo-boehmite produced by ChangLing Branch of Sinopec Catalyst Co., Ltd. was weighed, and 1000 ml of an aqueous solution containing 10 ml of nitric acid (chemically pure) was then added. The mixture was shaped by band extrusion on a double-screw extruder, dried at 120° C. for 4 hours, and calcined at 800° C. for 4 hours to obtain a catalyst carrier. The carrier was immersed in 900 ml of an aqueous solution containing 120 g of ammonium fluoride for 2 hours, dried at 120° C. for 3 hours, and calcined at 600° C. for 3 hours; after cooling to room temperature, the resultant was further immersed in 950 ml of an aqueous solution containing 133 g of ammonium metamolybdate for 3 hours, dried at 120° C. for 3 hours, and calcined at 600° C. for 3 hours; and after cooling to room temperature again, the resultant was finally immersed in 900 ml of an aqueous solution containing 180 g of nickel nitrate and 320 g of ammonium metatungstate for 4 hours, dried at 120° C. for 3 hours and calcined at 600° C. for 4 hours to produce a catalyst B.

TABLE 1

Properties of the feedstock oil used in the examples and comparative examples

| | Name of the feedstock oil | | |
|---|---|---|---|
| | Vacuum residue VR-1 | Hydrogenated heavy oil | VGO |
| Density, g/cm$^3$ | 0.9989 | 0.963 | 0.8597 |
| Viscosity (100° C.), mm$^2$/s | 319.4 | 92 | 4.96 |
| Carbon residue, wt % | 15.8 | 8.0 | 0.07 |
| Pentane asphaltene, wt % | 3.9 | 0.8 | 1.1 |
| Carbon, % | 85.19 | 87.28 | 85.63 |
| Hydrogen, % | 10.12 | 11.63 | 13.45 |
| Sulfur, % | 0.93 | 0.4 | 0.06 |
| Nitrogen, % | 0.26 | 0.195 | 0.08 |
| Nickel, g/g | 19.42 | 3.2 | 8.0 |
| Vanadium, g/g | 58.82 | 3.8 | 9.5 |

TABLE 2

Properties of the catalytic conversion catalysts used in the examples and comparative examples

| Name of the catalyst | A | MMC-1 |
|---|---|---|
| Chemical composition/wt % | | |
| $Al_2O_3$ | 49.2 | 50.2 |
| $Na_2O$ | 0.07 | 0.052 |
| Physical Properties | | |
| Specific surface area/(m$^2$ · g$^{-1}$) | / | 115 |
| Bulk density/(g · cm$^{-3}$) | 0.79 | 0.80 |
| Abrasion index/% · h$^{-1}$) | 1.1 | 2.8 |
| Sieve composition/wt % | | |
| 0-40 μm | 14.2 | 15.8 |
| 0-80 μm | 53.8 | 75.5 |
| 0-105 μm | / | 90.5 |
| 0-149 μm | 89.5 | / |

Example 1-a

This example was carried out in accordance with the process scheme shown in FIG. 1, using Vacuum residue VR-1 as a heavy feedstock oil. The heavy feedstock oil was subjected to a solvent deasphalting treatment with propane, and the properties of the deasphalted oil and the deoiled asphalt obtained are shown in Table 3.

A test was carried out on a medium-sized catalytic cracking unit comprising a varied-diameter fluidized bed reactor with 100% propane-deasphalted oil, using the catalyst A as a catalytic conversion catalyst. The resulting oil gas and spent catalyst were separated in a disengager, and the oil gas product was split into propylene, butylene, gasoline and a catalytic cracking distillate oil (with a distillation range of 250-500° C., and a hydrogen content of 9.4 wt %) according to the distillation ranges of those fractions in a fractionation unit. The reaction conditions and product distribution are listed in Table 4.

The catalytic cracking distillate oil obtained was sent to a hydrodesulfurization reactor together with hydrogen to contact with the hydrodesulfurization catalyst B, and react under a reaction pressure of 6.0 MPa, a reaction temperature of 350° C., a hydrogen-to-oil volume ratio of 350 and a liquid hourly space velocity of 2.0 h$^{-1}$ to obtain a low-sulfur hydrogenated distillate oil. The low-sulfur hydrogenated distillate oil was used as a fuel oil component and blended with a second fuel oil component (i.e. the deoiled asphalt obtained in this example) and a third fuel oil component, i.e. a hydrogenated diesel oil, to obtain a RMG 180 fuel oil product satisfying the National Standard GB 17411-2015, Marine Fuel Oils, of which the properties are shown in Table 5.

Example 1-b

This example was carried out as described in Example 1, except that a medium-sized unit comprising an equal-diameter riser reactor was used in place of the medium-sized catalytic cracking unit comprising a varied-diameter fluidized bed reactor. The resulting oil gas and spent catalyst were separated in a disengager, and the oil gas product was split into propylene, butylene, gasoline and a catalytic cracking distillate oil (with a distillation range of 250-500° C., and a hydrogen content of 9.4 wt %) according to the distillation ranges of those fractions in a fractionation unit. The reaction conditions and product distribution are listed in Table 4.

Example 2

This example was carried out in accordance with the process scheme shown in FIG. 1, using Vacuum residue VR-1 as a heavy feedstock oil. The heavy feedstock oil was subjected to a solvent deasphalting treatment with butane, and the properties of the deasphalted oil and the deoiled asphalt obtained are shown in Table 3.

A test was carried out on a medium-sized catalytic cracking unit comprising a varied-diameter fluidized bed reactor with a mixture of 80% butane deasphalted oil and 20% VGO, using the catalyst A as a catalytic conversion catalyst. The resulting oil gas and spent catalyst were separated in a disengager, and the oil gas product was split into propylene, butylene, gasoline and a catalytic cracking distillate oil (with a distillation range of 250-500° C., and a hydrogen content of 10.1 wt %) according to the distillation ranges of those fractions in a fractionation unit. The reaction conditions and product distribution are listed in Table 4.

The catalytic cracking distillate oil obtained was sent to a hydrodesulfurization reactor together with hydrogen to contact with the hydrodesulfurization catalyst B, and react under a reaction pressure of 7.0 MPa, a reaction temperature of 380° C., a hydrogen-to-oil volume ratio of 500 and a liquid hourly space velocity of 1.5 h$^{-1}$ to obtain a low-sulfur hydrogenated distillate oil. The low-sulfur hydrogenated distillate oil was used as a fuel oil component and blended with another fuel oil component (i.e. the deoiled asphalt obtained in this example), to obtain a RMG 380 fuel oil product satisfying the National Standard GB 17411-2015, Marine Fuel Oils, of which the properties are shown in Table 6.

Example 3

This example was carried out in accordance with the process scheme shown in FIG. 1, using Vacuum residue VR-1 as a heavy feedstock oil. The heavy feedstock oil was subjected to a solvent deasphalting treatment with pentane, and the properties of the deasphalted oil and the deoiled asphalt obtained are shown in Table 3.

A test was carried out on a medium-sized catalytic cracking unit comprising a varied-diameter fluidized bed reactor with a mixture of 60% pentane deasphalted oil and 40% VGO, using the catalyst A as a catalytic conversion catalyst.

The resulting oil gas and spent catalyst were separated in a disengager, and the oil gas product was split into propylene, butylene, gasoline and a catalytic cracking distillate oil (with a distillation range of 250-500° C., and a hydrogen content of 10.4 wt %) according to the distillation ranges of those fractions in a fractionation unit. The reaction conditions and product distribution are listed in Table 4.

The catalytic cracking distillate oil obtained was sent to a hydrodesulfurization reactor together with hydrogen to contact with the hydrodesulfurization catalyst B, and react under a reaction pressure of 8.0 MPa, a reaction temperature of 310° C., a hydrogen-to-oil volume ratio of 550 and a liquid hourly space velocity of 4.0 $h^{-1}$ to obtain a low-sulfur hydrogenated distillate oil. The low-sulfur hydrogenated distillate oil was used as a fuel oil component and blended with another fuel oil component (i.e. the deoiled asphalt obtained in this example), to obtain a RMG 180 fuel oil product satisfying the National Standard GB 17411-2015, Marine Fuel Oils, of which the properties are shown in in Table 7.

Comparative Example 1

This comparative example was carried out in accordance with the conventional deep catalytic cracking process described in CN1004878B, using VGO as a feedstock oil, and the catalyst MMC-1 as a catalytic cracking catalyst, on a medium-sized unit comprising a riser reactor in combination with a dense-phase fluidized bed. The resulting oil gas and spent catalyst were separated in a disengager, and the product was split into propylene, butylene, gasoline and a light cycle oil (with a distillation range of 200-350° C., and a hydrogen content of 9.8 wt %) according to the distillation ranges of those fractions in a fractionation unit. The reaction conditions and product distribution are listed in Table 4.

TABLE 3

Conditions and results of the solvent deasphalting performed in Examples 1-3

| | Example 1-a | Example 2 | Example 3 |
|---|---|---|---|
| Solvent | Propane | Butane | Pentane |
| Solvent deasphalting conditions | | | |
| Operating temperature, ° C. | 65.0 | 126.0 | 149.0 |
| Operating pressure, MPa | 3.8 | 4.0 | 3.5 |
| Solvent ratio | 3.2 | 3.9 | 4.5 |
| Yield of deasphalted oil, /% | 47.2 | 71.8 | 86.4 |
| Yield of deoiled asphalt, /% | 52.8 | 28.2 | 13.6 |
| Propertiesof deasphalted oil | | | |
| Density, g/cm$^3$ | 0.9292 | 0.9461 | 0.9701 |
| Viscosity (100° C.), mm$^2$/s | 32.3 | 58.3 | 97.2 |
| Carbon residue, wt % | 1.6 | 5.1 | 7.6 |
| Pentane asphaltene, wt % | <0.05 | <0.05 | <0.05 |
| Sulfur, % | 0.81 | 0.82 | 0.88 |
| Nitrogen, g/g | 1080 | 1755 | 1953 |
| Nickel, g/g | 1.02 | 2.04 | 7.15 |
| Vanadium, g/g | 1.35 | 2.51 | 14.95 |
| Properties of deoiled asphalt | | | |
| Softening point, ° C. | 90.4 | >160 | >170 |
| Penetration (25° C.), $10^{-1}$ mm | 13 | 0 | 0 |
| Relative density (25° C.), g/cm$^3$ | 1.058 | 1.097 | 1.135 |
| Viscosity (100° C.), mm$^2$/s | 554.2 | 3001.0 | 5876.8 |

TABLE 4

Conditions and product distribution of the catalytic conversion reaction conducted in Examples 1-3 and Comparative Example 1

| | Example 1-a | Example 1-b | Example 2 | Example 3 | Comparative Example 1 |
|---|---|---|---|---|---|
| Feedstock oil | 100% propane-deasphalted oil | 100% propane-deasphalted oil | 80% butane deasphalted oil + 20% VGO | 60% pentane deasphalted oil + 40% VGO | VGO |
| Properties of feedstock oil | | | | | |
| Density, g/cm$^3$ | 0.9292 | 0.9292 | 0.9288 | 0.9259 | 0.8597 |
| Carbon residue, wt % | 1.6 | 1.6 | 4.09 | 4.59 | 0.07 |
| Type of reactor | Varied-diameter fluidized bed | Equal-diameter riser reactor | Varied-diameter fluidized bed | Varied-diameter fluidized bed | Riser reactor + dense-phase fluidized bed |
| Temperature of first reaction zone/° C. | 530 | 530 (reaction temperature, ° C.) | 530 | 530 | 580 (riser reactor) |
| Time in first reaction zone, s | 1.2 (WHSV of about 95 $h^{-1}$) | | 1.2 (WHSV of about 95 $h^{-1}$) | 1.2 (WHSV of about 95 $h^{-1}$) | 1.2 (riser reactor) |
| Temperature of second reaction zone/° C. | 520 | 3.5 (reaction time, s) | 520 | 520 | 580 (dense-phase fluidized bed) |
| Space velocity in second reaction zone/$h^{-1}$ | 30 | | 30 | 30 | 4 (dense-phase fluidized bed) |
| Catalyst-to-oil ratio | 6 | 6 | 6 | 6 | 10 |
| Product distribution/wt % | | | | | |
| Dry gas | 1.89 | 2.10 | 1.98 | 1.95 | 11.97 |
| Liquefied gas | 27.62 | 28.77 | 27.83 | 28.00 | 42.91 |
| Gasoline | 28.93 | 27.87 | 28.38 | 28.21 | 28.33 |
| Light cycle oil | 0 | 0 | 0 | 0 | 10.94 |
| Catalytic cracking distillate oil | 37.53 | 36.00 | 36.12 | 35.74 | 0.00 |
| Coke | 4.03 | 5.26 | 5.69 | 6.10 | 5.85 |
| Total | 100.00 | 100.00 | 100.00 | 100.00 | 100.00 |
| Conversion* | 62.47 | 64.00 | 63.88 | 64.26 | 89.06 |
| Propylene yield/wt % | 11.8 | 11.20 | 12.0 | 12.2 | 19.07 |

TABLE 4-continued

Conditions and product distribution of the catalytic conversion reaction conducted in Examples 1-3 and Comparative Example 1

| | Example 1-a | Example 1-b | Example 2 | Example 3 | Comparative Example 1 |
|---|---|---|---|---|---|
| Propylene/propane mass ratio | 8.10 | 8.00 | 8.15 | 8.25 | 6.2 |
| Isobutene/isobutane mass ratio | 1.85 | 1.80 | 1.85 | 1.86 | 0.1 |
| Total liquid yield/wt % | 94.08 | 92.64 | 92.33 | 91.95 | 82.18 |

*Conversion = dry gas yield + liquefied gas yield + gasoline yield + coke yield.

As can be seen from the results of Table 4, Example 1-a and Example 1-b can provide not only a propylene yield of more than 5 wt %, but also a fuel oil component yield of about 70 wt % (calculated on the basis of the hydrogenated distillate oil+deoiled asphalt, relative to the Vacuum residue VR-1 used as the heavy feedstock oil). When compared to Comparative Example 1, the yield of dry gas of Example 1-a and Example 1-b is markedly reduced, and the total liquid yield is significantly increased.

TABLE 5

Properties of the low-sulfur hydrogenated distillate oil and fuel oil product obtained in Example 1-a

| | Fuel oil component 1 | Fuel oil component 2 | Fuel component 3 | RMG180 fuel oil product | Standard for RMG180 fuel oil |
|---|---|---|---|---|---|
| Component name | Low-sulfur hydrogenated distillate oil | Deoiled asphalt | Hydrogenated diesel oil | | |
| Blend ratio/% (w) | 14.6 | 45.8 | 39.6 | | |
| Viscosity (50° C.)/($mm^2/s$) | 9.5 | / | 2.0 | 107.0 | > 180 |
| Density (15° C.)/($kg/m^3$) | 928.2 | 1058.2 | 903.4 | 978.0 | > 991.0 |
| Density (20° C.)/($kg/m^3$) | 927.3 | 1051.4 | 900.8 | 973.7 | > 987.6 |
| Calculated carbon aromaticity index (CCAI) | 846.3 | 885.2 | 870.7 | 853.5 | > 870 |
| Sulfur content/% (w) | 0.04 | 1.04 | 0.02 | 0.49 | ≯ 0.5 |
| Total acid value/(mgKOH/g) | 0.09 | 0.90 | 0.03 | 0.44 | ≯ 2.5 |
| Carbon residue/% (w) | 0.0 | 28.49 | 0.00 | 13.1 | ≯ 18.0 |

TABLE 6

Properties of the low-sulfur hydrogenated distillate oil and fuel oil product obtained in Example 2

| | Fuel oil component 1 | Fuel oil component 2 | RMG 380 fuel oil products | Standard for RMG 380 fuel oil |
|---|---|---|---|---|
| Component name | Low-sulfur hydrogenated distillate oil | Deoiled asphalt | | |
| Blend ratio/% (w) | 62.3 | 37.7 | | |
| Viscosity (50° C.)/($mm^2/s$) | 9.4 | / | 210.3 | ≯ 380 |
| Density (15° C.)/($kg/m^3$) | 926.2 | 1097.1 | 990.7 | ≯ 991.0 |
| Density (20° C.)/($kg/m^3$) | 925.3 | 1089.3 | 987.2 | ≯ 987.6 |
| Calculated carbon aromaticity index (CCAI) | 844.6 | 909.6 | 858.0 | ≯ 870 |
| Sulfur content/% (w) | 0.05 | 1.21 | 0.49 | > 0.5 |
| Total acid value/(mgKOH/g) | 0.06 | 1.19 | 0.49 | > 2.5 |
| Carbon residue/% (w) | 0.0 | 43.04 | 16.23 | ≯ 18.0 |

TABLE 7

Properties of the low-sulfur hydrogenated distillate oil and fuel oil product obtained in Example 3

| | Fuel oil component 1 | Fuel oil component 2 | RMG180 fuel oil products | Standard for RMG180 fuel oil |
|---|---|---|---|---|
| Component name | Low-sulfur hydrogenated distillate oil | Deoiled asphalt | | |
| Blend ratio/% (w) | 78.4 | 21.6 | | |
| Viscosity (50° C.)/($mm^2$/s) | 9.7 | / | 107.2 | ≯ 180 |
| Density (15° C.)/(kg/$m^3$) | 928.4 | 1135.4 | 973.1 | ≯ 991.0 |
| Density (20° C.)/(kg/$m^3$) | 927.1 | 1128.6 | 970.7 | ≯ 987.6 |
| Calculated carbon aromaticity index (CCAI) | 846.0 | 943.0 | 848.7 | ≯ 870 |
| Sulfur content/% (w) | 0.05 | 1.30 | 0.32 | ≯ 0.5 |
| Total acid value/(mgKOH/g) | 0.10 | 1.45 | 0.39 | ≯ 2.5 |
| Carbon residue/% (w) | 0.0 | 67.9 | 14.7 | ≯ 18.0 |

Example 4

This example was carried out in accordance with the process scheme shown in FIG. 2, using the hydrogenated heavy oil as a heavy feedstock oil. The heavy feedstock oil was subjected to a solvent deasphalting treatment with butane, and the properties of the light deasphalted oil, the heavy deasphalted oil and the deoiled asphalt are shown in Table 8.

A test was carried out on a medium-sized catalytic cracking unit comprising a varied-diameter fluidized bed reactor with 100% light butane-deasphalted oil, using the catalyst A as a catalytic conversion catalyst. The resulting oil gas and spent catalyst were separated in a disengager, and the oil gas product was split into propylene, butylene, gasoline and a catalytic cracking distillate oil (with a distillation range of 250-500° C., and a hydrogen content of 10.4 wt %) according to the distillation ranges of those fractions in a fractionation unit. The reaction conditions and product distribution are shown in Table 9.

The catalytic cracking distillate oil obtained was sent to a hydrodesulfurization reactor together with hydrogen to contact with the hydrodesulfurization catalyst B, and react under a reaction pressure of 9.0 MPa, a reaction temperature of 330° C., a hydrogen-to-oil volume ratio of 650 and a liquid hourly space velocity of 8.0 $h^{-1}$ to obtain a low-sulfur hydrogenated distillate oil. The low-sulfur hydrogenated distillate oil was used as a fuel oil component and blended with another fuel oil component "vacuum residue VR-2", to obtain a RMG 180 fuel oil product satisfying the National Standard GB 17411-2015, Marine Fuel Oils, of which the properties are shown in in Table 10.

Example 5

This example was carried out in accordance with the process scheme shown in FIG. 2, using the hydrogenated heavy oil as a heavy feedstock oil. The heavy feedstock oil was subjected to a solvent deasphalting treatment with propane, and the properties of the light deasphalted oil, the heavy deasphalted oil and the deoiled asphalt are shown in Table 8.

A test is carried out on a medium-sized catalytic cracking unit comprising a varied-diameter fluidized bed reactor with 100% light propane-deasphalted oil, using the catalyst A as a catalytic conversion catalyst. The resulting oil gas and spent catalyst were separated in a disengager, and the oil gas product was split into propylene, butylene, gasoline and a catalytic cracking distillate oil (with a distillation range of 250-500° C., and a hydrogen content of 10.5 wt %) according to the distillation ranges of those fractions in a fractionation unit. The reaction conditions and product distribution are shown in Table 9.

The catalytic cracking distillate oil obtained was sent to a hydrodesulfurization reactor together with hydrogen to contact with the hydrodesulfurization catalyst B, and react under a reaction pressure of 6.0 MPa, a reaction temperature of 350° C., a hydrogen-to-oil volume ratio of 350 and a liquid hourly space velocity of 4.0 $h^{-1}$ to obtain a low-sulfur hydrogenated distillate oil. The low-sulfur hydrogenated distillate oil was used as a fuel oil component, and blended with a second fuel oil component (i.e. the heavy deasphalted oil obtained in this example) and a third fuel oil component "vacuum residue VR-3", to obtain a RMG 380 fuel oil product satisfying the National Standard GB 17411-2015, Marine Fuel Oils, of which the properties are shown in in Table 11.

TABLE 8

Conditions and results of the solvent deasphalting performed in Examples 4-5

| Item | Example 4 | Example 5 |
|---|---|---|
| Solvent | Butane | Propane |
| Solvent deasphalting conditions | | |
| Operating temperature, ° C. | 126.0 | 65.0 |
| Operating pressure, MPa | 4.0 | 3.8 |
| Solvent ratio | 3.9 | 3.2 |
| Yield of light deasphalted oil/% | 51.12 | 37.18 |
| Yield of heavy deasphalted oil/% | 20.58 | 18.22 |
| Yield of deoiled asphalt/% | 28.3 | 44.6 |
| Properties of light deasphalted oil | | |
| Density, g/$cm^3$ | 0.912 | 0.896 |
| Viscosity (100° C.), $mm^2$/s | 25 | 19 |
| Carbon residue, % | 2.6 | 0.8 |
| Pentane asphaltene,% | <0.05 | <0.05 |
| Sulfur, % | 0.33 | 0.25 |
| Nitrogen, % | 0.13 | 0.08 |
| Nickel, g/g | 0.34 | 0.16 |
| Vanadium, g/g | 0.16 | 0.09 |
| Properties of heavy deasphalted oil | | |
| Viscosity (100° C.), $mm^2$/s | 1256.8 | 435.8 |
| Sulfur, % | 0.35 | 0.27 |

TABLE 8-continued

| Conditions and results of the solvent deasphalting performed in Examples 4-5 | | |
|---|---|---|
| Item | Example 4 | Example 5 |
| Properties of deoiled asphalt | | |
| Softening point, ° C. | 89.9 | 80.6 |
| Penetration (25° C.), $10^{-1}$ mm | 13 | 15 |
| Relative density (25° C.), g/cm$^3$ | 1.058 | 1.021 |
| Viscosity (100° C.), mm$^2$/s | 1393.5 | 521.4 |

TABLE 9

| Conditions and product distribution of the catalytic conversion reaction conducted in Examples 4-5 | | |
|---|---|---|
| | Example 4 | Example 5 |
| Feedstock oil for catalytic conversion | 100% light butane-deasphalted oil | 100% light propane-deasphalted oil |
| Properties of feedstock oil for catalytic conversion | | |
| Density, g/cm$^3$ | 0.912 | 0.896 |
| Carbon residue, wt % | 2.6 | 0.8 |
| Type of catalytic conversion reactor | Varied-diameter fluidized bed | Varied-diameter fluidized bed |

TABLE 9-continued

| Conditions and product distribution of the catalytic conversion reaction conducted in Examples 4-5 | | |
|---|---|---|
| | Example 4 | Example 5 |
| Conditions of catalytic conversion | | |
| Temperature of first reaction zone/° C. | 530 | 530 |
| Time in first reaction zone, s | 1.2 (WHSV of about 95 h$^{-1}$) | 1.2 (WHSV of about 95 h$^{-1}$) |
| Temperature of second reaction zone/° C. | 520 | 520 |
| Space velocity in second reaction zone, h$^{-1}$ | 30 | 30 |
| Catalyst-to-oil ratio | 6 | 6 |
| Product distribution/wt % | | |
| Dry gas | 1.91 | 1.85 |
| Liquefied gas | 27.12 | 30.66 |
| Gasoline | 30.87 | 31.91 |
| Light cycle oil | 0 | 0 |
| Catalytic cracking distillate oil | 35.12 | 32.55 |
| Coke | 4.98 | 3.03 |
| Total | 100.00 | 100.00 |
| Conversion* | 64.88 | 67.45 |
| Propylene yield/wt % | 12.1 | 12.8 |
| Propylene/propane mass ratio | 8.10 | 8.20 |
| Isobutene/isobutane mass ratio | 1.82 | 1.85 |
| Total liquid yield/wt % | 93.11 | 95.12 |

*Conversion = dry gas yield + liquefied gas yield + gasoline yield + coke yield.

TABLE 10

| Properties of the low-sulfur hydrogenated distillate oil and fuel oil product obtained in Example 4 | | | | |
|---|---|---|---|---|
| | Fuel oil component 1 | Fuel oil component 2 | RMG 180 fuel oil products | Standard for RMG 180 fuel oil |
| Component name | Low-sulfur hydrogenated distillate oil | Vacuum residue VR-2 | | |
| Blend ratio/% (w) | 35 | 65 | | |
| Viscosity (50° C.)/(mm$^2$/s) | 9.7 | 2004.5 | 162.3 | ≯ 180 |
| Density (15° C.)/(kg/m$^3$) | 929.3 | 1003.2 | 977.4 | ≯ 991.0 |
| Density (20° C.)/(kg/m$^3$) | 927.5 | 1000.1 | 975.2 | ≯ 987.6 |
| Calculated carbon aromaticity index (CCAI) | 846.9 | 849.1 | 847.7 | ≯ 870 |
| Sulfur content/% (w) | 0.05 | 0.71 | 0.48 | > 0.5 |
| Total acid value/(mgKOH/g) | 0.1 | 0.71 | 0.50 | > 2.5 |
| Carbon residue/% (w) | 0.0 | 19.4 | 12.61 | ≯ 18.0 |

TABLE 11

| Properties of the low-sulfur hydrogenated distillate oil and fuel oil product obtained in Example 5 | | | | | |
|---|---|---|---|---|---|
| | Fuel oil component 1 | Fuel oil component 2 | Fuel oil compositions 3 | RMG 380 fuel oil product | Standard for RMG 380 fuel oil |
| Component name | Low-sulfur hydrogenated distillate oil | Heavy deasphalted oil | Vacuum residue VR-3 | | |
| Blend ratio/% (w) | 26 | 41.2 | 32.8 | | |
| Viscosity (50° C.)/(mm$^2$/s) | 9.8 | 1978.6 | 1997.5 | 298.5 | ≯ 380 |
| Density (15° C.)/(kg/m$^3$) | 928.4 | 997.6 | 1000.6 | 980.7 | ≯ 991.0 |
| Density (20° C.)/(kg/m$^3$) | 927.3 | 993.2 | 997.5 | 977.5 | ≯ 987.6 |
| Calculated carbon aromaticity index (CCAI) | 845.8 | 843.6 | 846.5 | 844.1 | ≯ 870 |

TABLE 11-continued

Properties of the low-sulfur hydrogenated distillate oil and fuel oil product obtained in Example 5

| | Fuel oil component 1 | Fuel oil component 2 | Fuel oil compositions 3 | RMG 380 fuel oil product | Standard for RMG 380 fuel oil |
|---|---|---|---|---|---|
| Sulfur content/% (w) | 0.05 | 0.58 | 0.74 | 0.49 | ≯0.5 |
| Total acid value/(mgKOH/g) | 0.11 | 0.72 | 0.76 | 0.58 | ≯2.5 |
| Carbon residue/% (w) | 0.0 | 2.55 | 16.36 | 6.42 | ≯18.0 |

As can be seen from the results shown in the above Tables, the process of the present application can provide a high value product, i.e. propylene, while producing a certain amount of fuel oil component.

Preferred embodiments of the present application have been described in detail hereinabove, but the present application is not limited to the details of those embodiments. Various modifications may be made without departing from the spirit of the present application, and these modifications also fall within the scope of the present application.

It should be noted that the various technical features described in the above embodiments can be combined in any suitable manner without contradiction. For brevity, various possible combinations are not described separately in the present application, but such combinations also fall within the scope of the present application.

In addition, various embodiments of the present application can be combined in any manner as long as it does not depart from the spirit of the present application, and such combinations should be considered as a part of the disclosure of the present application.

What is claimed:

1. A process for producing propylene and a marine fuel oil, comprising the steps of:

(1) contacting a heavy feedstock oil with a solvent for extraction separation to obtain a light deasphalted oil, a heavy deasphalted oil and a deoiled asphalt;

(2) contacting the light deasphalted oil and an optional feedstock oil with a catalytic conversion catalyst for reaction in a catalytic conversion reactor in the absence of hydrogen to obtain a reaction product and controlling a conversion rate of the catalytic conversion process at 50% to 70%;

(3) separating the reaction product from step (2) to obtain a plurality of product streams that include propylene, a catalytic cracking distillate oil, and gasoline, wherein the catalytic cracking distillate oil has an initial boiling point of no less than about 200° C., a final boiling point of no greater than about 550° C., and a hydrogen content of no greater than 10.5 wt %;

(4) subjecting the catalytic cracking distillate oil to hydrodesulfurization at a reaction pressure of 6-9 MPa to obtain a low-sulfur hydrogenated distillate oil having a sulfur content of no more than 0.1 wt %; and (5) mixing the low-sulfur hydrogenated distillate oil with one or more fuel oil components selected from the heavy deasphalted oil, a vacuum residue, and the deoiled asphalt to obtain the marine fuel oil having a viscosity at 50° C. of not more than 380 $mm^2/s$ and a sulfur content of not more than 0.5 wt %, wherein the catalytic conversion catalyst used in step (2) comprises about 1-50 wt % zeolite, about 5-99 wt % inorganic oxide, and about 0-70 wt % clay, based on the total weight of the catalyst, and wherein the reaction conditions of the step (2) include: a reaction temperature of about 460-750° C.; a weight hourly space velocity of about 10-100 $h^{-1}$ or a reaction time of about 1-10 seconds;

and a catalyst-to-oil weight ratio of about 4-20, wherein the optional feedstock oil in step (2) is selected from the group consisting of petroleum hydrocarbons, mineral oils, and mixtures thereof, wherein the petroleum hydrocarbon is selected from the group consisting of vacuum gas oils, atmospheric gas oils, coker gas oils, high-quality residues, high-quality hydrogenated heavy oils, and mixtures thereof, and the mineral oil is selected from the group consisting of coal liquefied oils, tar sand oils, shale oils, and mixtures thereof, wherein the high-quality residue is a residue having a hydrogen content of 11.2 wt % or more, and the high-quality hydrogenated heavy oil is a hydrogenated heavy oil having a hydrogen content of 11.2 wt % or more, wherein the zeolite comprises about 51-100 wt % of a mesoporous zeolite and about 0-49 wt % of a macroporous zeolite, based on the total weight of the zeolite in the catalytic conversion catalyst, and wherein the mesoporous zeolite has a silica-alumina ratio of greater than about 10.

2. The process according to claim 1, wherein the reaction conditions of the step (2) include: a reaction temperature of about 480-700° C., a weight hourly space velocity of about 30-100 $h^{-1}$ or a reaction time of about 2-8 seconds, and a catalyst-to-oil weight ratio of about 5-12, and wherein the mesoporous zeolite has a silica-alumina ratio of greater than about 50, the mesoporous zeolite is selected from the group consisting of ZSM-type zeolites and ZRP zeolites; and the macroporous zeolite is a Y-type zeolite.

3. The process according to claim 2, wherein step (2) is carried out to such an extent that the reaction product from step (2) has a propylene/propane mass ratio of no less than about 4, and/or an isobutene/isobutane mass ratio of no less than about 1.

4. The process according to claim 3, wherein step (2) is carried out to such an extent that the yield of the catalytic cracking distillate oil in the reaction product from step (2) is not less than about 30 wt %.

5. The process according to claim 2, wherein step (2) is carried out to such an extent that the yield of the catalytic cracking distillate oil in the reaction product from step (2) is not less than about 30 wt %.

6. The process according to claim 1, wherein step (2) is carried out to such an extent that the reaction product from step (2) has a propylene/propane mass ratio of no less than about 4, and/or an isobutene/isobutane mass ratio of no less than about 1.

7. The process according to claim 1, wherein step (2) is carried out to such an extent that the yield of the catalytic cracking distillate oil in the reaction product from step (2) is not less than about 15 wt %.

8. The process according to claim 1, wherein the heavy feedstock oil is selected from the group consisting of vacuum residues, atmospheric residues, hydrogenated heavy oils, and mixtures thereof.

9. The process according to claim 1, wherein the solvent is selected from the group consisting of propane, butane, pentane, and mixtures thereof.

10. The process according to claim 1, wherein the conditions for extraction separation of step (1) include: a temperature of about 10-200° C., an operating pressure of about 1.0-15.0 MPa, and a mass ratio of the solvent to the feedstock oil of about 1-20.

11. The process according to claim 1, wherein the catalytic conversion reactor used in step (2) is a single fluidized bed reactor or a composite reactor comprising a plurality of fluidized bed reactors connected in series or in parallel.

12. The process according to claim 1, wherein the catalytic cracking distillate oil of step (3) has an initial boiling point of no less than about 250° C. and a final boiling point of no greater than about 520° C.

13. The process according to claim 1, wherein a catalyst comprising a Group VIB metal and/or a Group VIII metal supported on an alumina and/or amorphous silica-alumina carrier is used in the hydrodesulfurization step (4).

14. The process according to claim 13, wherein the catalyst used in the hydrodesulfurization step (4) comprises about 0-10 wt % of an additive, about 1-40 wt % of at least one Group VIII metal (calculated as metal oxide), and about 1-50 wt % of at least one Group VIB metal (calculated as metal oxide), with the balance being a carrier selected from alumina and amorphous silica-alumina, wherein the additive comprises an element selected from the group consisting of fluorine, phosphorus, titanium, platinum, and a combination thereof.

15. The process according to claim 1, wherein the conditions of the hydrodesulfurization step (4) further include: a reaction temperature of about 200-500° C., a hydrogen-to-oil volume ratio of about 50-5000 $N^3/m^3$, and a liquid hourly space velocity of about 0.1-30.0 $h^{-1}$.

16. The process according to claim 1, further comprising separating gasoline from step (3) to obtain a light gasoline fraction, and feeding the light gasoline fraction to the catalytic conversion reactor.

17. The process according to claim 1, wherein the plurality of product streams from step (3) further include a slurry oil, further comprising feeding the slurry oil into the catalytic conversion reactor.

18. The process according to claim 1, wherein the hydrogen content of the catalytic cracking distillate oil ranges from 9.4 wt % to 10.4 wt %.

* * * * *